US010378386B2

(12) United States Patent
Roussille et al.

(10) Patent No.: US 10,378,386 B2
(45) Date of Patent: Aug. 13, 2019

(54) TURBINE RING ASSEMBLY WITH SUPPORT WHEN COLD AND WHEN HOT

(71) Applicant: SAFRAN AIRCRAFT ENGINES, Paris (FR)

(72) Inventors: Clément Roussille, Bordeaux (FR); Thierry Tesson, Bordeaux (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/063,050

(22) PCT Filed: Dec. 14, 2016

(86) PCT No.: PCT/FR2016/053395
§ 371 (c)(1),
(2) Date: Jun. 15, 2018

(87) PCT Pub. No.: WO2017/103451
PCT Pub. Date: Jun. 22, 2017

(65) Prior Publication Data

US 2018/0363507 A1 Dec. 20, 2018

(30) Foreign Application Priority Data

Dec. 18, 2015 (FR) ..... 15 62741

(51) Int. Cl.
*F01D 11/02* (2006.01)
*F01D 25/24* (2006.01)
*F01D 11/18* (2006.01)

(52) U.S. Cl.
CPC ..... *F01D 25/246* (2013.01); *F01D 11/025* (2013.01); *F01D 11/18* (2013.01);
(Continued)

(58) Field of Classification Search
CPC ..... F01D 25/246; F01D 11/025; F01D 11/18; F01D 11/16
See application file for complete search history.

(56) References Cited

U.S. PATENT DOCUMENTS 9,080,463 B2 * 7/2015 Denece ..... F01D 9/04
2012/0027572 A1 2/2012 Denece et al.
2012/0237342 A1 * 9/2012 Berche ..... F01D 11/005 415/174.1

FOREIGN PATENT DOCUMENTS

WO WO 2006/136755 A2 12/2003
WO WO 2015/191186 A1 12/2015
WO WO-2015191186 A1 * 12/2015 ..... F01D 9/04

OTHER PUBLICATIONS

International Preliminary Report on Patentability and the Written Opinion of the International Searching Authority as issued in International Patent Application No. PCT/FR2016/053395, dated Jun. 19, 2018.

(Continued)

*Primary Examiner* — Justin D Seabe
*Assistant Examiner* — Sabbir Hasan
(74) *Attorney, Agent, or Firm* — Pillsbury Winthrop Shaw Pittman LLP

(57) ABSTRACT

A turbine ring assembly includes ring sectors forming a turbine ring, and a ring support structure having two annular flanges, each ring sector having a portion forming an annular base with an inner face defining the inside face of the turbine ring and an outer face from which there project at least two tabs, the tabs being retained between the two annular flanges. Each tab of the ring sectors includes a projecting portion on its face situated facing one of the two annular flanges, this projecting portion co-operating with a housing present in the annular flange. Each tab of the ring sectors includes an opening in which there is received a portion of (Continued)

a retention element secured to the annular flange situated facing the tab. The retention element is made of a material having a thermal expansion coefficient that is greater than that of the material of the ring sectors.

6 Claims, 3 Drawing Sheets

(52) U.S. Cl.
CPC .. *F05D 2230/642* (2013.01); *F05D 2230/644* (2013.01); *F05D 2240/11* (2013.01); *F05D 2300/6033* (2013.01)

(56) References Cited

OTHER PUBLICATIONS

International Search Report as issued in International Patent Application No. PCT/FR2016/053395, dated Mar. 13, 2017.

* cited by examiner

TURBINE RING ASSEMBLY WITH SUPPORT WHEN COLD AND WHEN HOT

CROSS REFERENCE TO RELATED APPLICATIONS

This application is the U.S. National Stage of PCT/FR2016/053395 filed Dec. 14, 2016, which in turn claims priority to French Application No. 1562741, filed Dec. 18, 2015. The contents of both applications are incorporated herein by reference in their entirety.

BACKGROUND OF THE INVENTION

The field of application of the invention is particularly that of gas turbine aeroengines. Nevertheless, the invention is applicable to other turbine engines, e.g. industrial turbines.

Ceramic matrix composite (CMC) materials are known for conserving their mechanical properties at high temperatures, which makes them suitable for constituting hot structural elements.

For turbine ring assemblies that are made entirely out of metal, it is necessary to cool all of the elements of the assembly, and in particular the turbine ring, which is subjected to particularly hot streams. Such cooling has a significant impact on the performance of the engine, since the cooling stream used is taken from the main stream through the engine. In addition, the use of metal for the turbine ring limits possibilities for increasing temperature within the turbine, even though that would improve the performance of aeroengines.

Furthermore, a metal turbine ring assembly deforms under the effect of hot streams, thereby changing clearances associated with the flow passage, and consequently modifying the performance of the turbine.

That is why proposals have already been made to use CMC for various hot portions of engines, particularly since CMCs present the additional advantage of density that is lower than that of the refractory metals conventionally used.

The use of ring sectors made of CMC makes it possible to reduce significantly the amount of ventilation needed for cooling the turbine ring. Nevertheless, keeping or retaining ring sectors in position remains a problem in particular in the face of differential expansion, as can occur between a metal support structure and CMC ring sectors. In addition, another problem lies in controlling the shape of the passage both when cold and when hot without generating successive stresses in the ring sectors.

Also known is Document WO 2015/191186, which discloses a turbine ring assembly.

There thus exists a need to improve existing turbine ring assemblies that make use of a CMC material in order to ensure that ring sectors are retained in position in spite of differential expansion, while also limiting the magnitude of the mechanical stresses to which the CMC ring sectors are subjected in operation.

OBJECT AND SUMMARY OF THE INVENTION

To this end, in a first aspect, the invention provides a turbine ring assembly comprising a plurality of ring sectors made of ceramic matrix composite material forming a turbine ring, and a ring support structure having two annular flanges, each ring sector having a portion forming an annular base with an inner face defining the inside face of the turbine ring and an outer face from which there project at least two tabs, the tabs of each ring sector being retained between the two annular flanges of the ring support structure, the ring assembly being characterized in that each tab of the ring sectors includes a projecting portion on its face situated facing one of the two annular flanges, this projecting portion co-operating with a housing present in the annular flange, and in that each tab of the ring sectors includes at least one opening in which there is received a portion of a retention element secured to the annular flange situated facing said tab, clearance being present between the opening of said tab and the portion of the retention element present in said opening, said retention element being made of a material having a coefficient of thermal expansion that is greater than the coefficient of thermal expansion of the ceramic matrix composite material of the ring sectors.

In the ring assembly of the invention, the ring sectors are retained when cold because of the co-operation between the projecting portions and the facing housings present in the annular flanges. The retention of the ring sectors by this co-operation between portions in relief can no longer be ensured when hot because of the expansion of the annular flanges. When hot, the retention force is taken up by expansion of the retention elements, which expansion does not lead to significant stress on the ring sectors because of the presence of clearance when cold between the retention elements and the openings situated in the tabs of the ring sector.

In an embodiment, the housing of the annular flange may present at least one sloping portion that, when observed in meridian section, forms a non-zero angle relative to the radial direction and to the axial direction and that comes to bear against the projecting portion co-operating with said housing.

The radial direction corresponds to the direction along a radius of the turbine ring (a straight line connecting the center of the turbine ring to its periphery). The axial direction corresponds to the direction along the axis of revolution of the turbine ring and also to the flow direction of the gas stream through the passage.

The use of such sloping portions in the annular flanges of the ring support structure contributes to compensating for differences in expansion between the annular flanges and the ring sector tabs, thereby reducing mechanical stresses to which the ring sectors are subjected in operation.

In an embodiment, the housing in the annular flange may present at least first and second sloping portions bearing against the projecting portion co-operating with said housing, said first and second sloping portions, when observed in meridian section, may each form a non-zero angle relative to the radial direction and relative to the axial direction.

In particular, the first sloping portion may bear against the radially inner half of the projecting portion, and the second sloping portion may bear against the radially outer half of the projecting portion.

In an embodiment, said at least one sloping portion may form an angle relative to the radial direction lying in the range 30° to 60°.

In an embodiment, the ratio of the diameter of the portion of the retention element that is present in said opening divided by the diameter of said opening may lie in the range $(1+\alpha_{CMC})/(1+\alpha_m)$ to $1.1\times(1+\alpha_{CMC})/(1+\alpha_m)$, where $\alpha_m$ designates the coefficient of thermal expansion of said portion of the retention element and $\alpha_{CMC}$ designates the coefficient of thermal expansion of the ceramic matrix composite material of the ring sectors, $\alpha_m$ and $\alpha_{CMC}$ being measured at 900° C. and being expressed as $10^{-6}\times°\ C.^{-1}$.

Such values for the ratio between the diameter of the portion of the retention element present in said opening and the diameter of said opening serve to ensure that the ring sectors are well retained when hot because of the clearance present between the opening and the retention element being fully or substantially fully absorbed as a result of the expansion of the retention element.

In an embodiment, each ring sector may present a Pi-shape in axial section.

The present invention also provides a turbine engine including a turbine ring assembly as described above.

BRIEF DESCRIPTION OF THE DRAWINGS

Other characteristics and advantages of the invention appear from the following description of a particular non-limiting embodiment of the invention given with reference to the accompanying drawings, in which.

DETAILED DESCRIPTION OF EMBODIMENTS

Figures 1, 2:
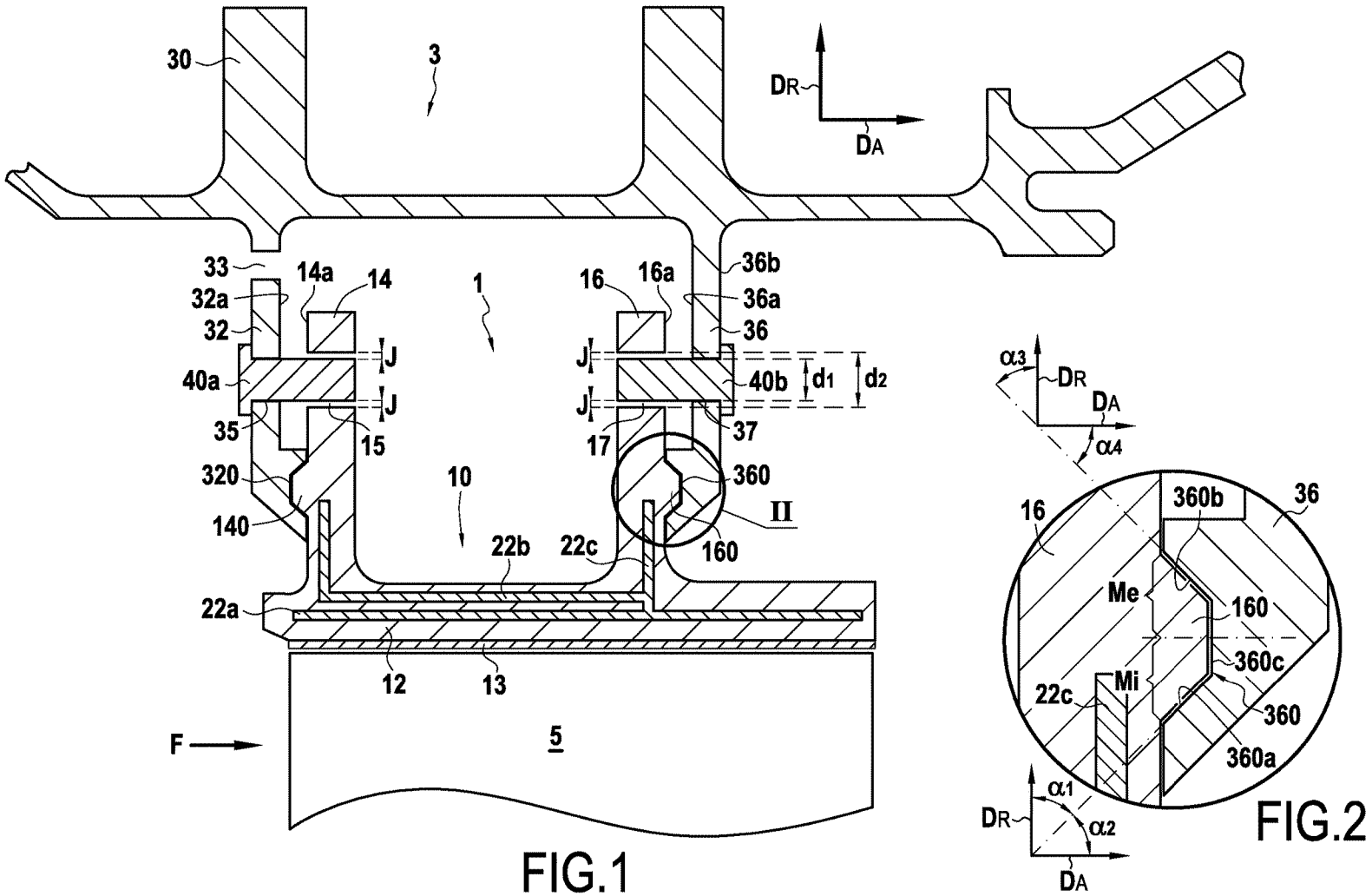
FIG. 1 is a radial section view of an example turbine ring assembly of the invention.
FIG. 2 shows a detail of FIG. 1.

FIG. 1 shows a high pressure turbine ring assembly comprising a turbine ring 1 made of ceramic matrix composite (CMC) material and a metal ring support structure 3. The turbine ring 1 surrounds a set of rotary blades 5. The turbine ring 1 is made up of a plurality of ring sectors 10, FIG. 1 being a radial section view on a plane passing between two consecutive ring sectors. The ring sectors 10 in the example shown are Pi-shaped in axial section. Arrow DA shows the axial direction relative to the turbine ring 1, while arrow DR shows the radial direction relative to the turbine ring 1.

Each ring sector 10 is of cross-section that is substantially in the shape of an upside-down Greek letter π with an annular base 12 having its inner face coated in a layer 13 of abradable material that defines the flow passage for the gas stream through the turbine. Upstream and downstream tabs 14 and 16 extend from the outer face of the annular base 12 in the radial direction DR. The terms "upstream" and "downstream" are used herein relative to the flow direction of the gas stream through the turbine (arrow F).

The ring support structure 3, which is secured to a turbine casing 30, has an upstream annular radial flange 32 and a downstream annular radial flange 36. The tabs 14 and 16 of each ring sector 10 are retained between the flanges 32 and 36. Each of the annular flanges 32 and 36 defines a respective housing 320 or 360. These housings 320 and 360 co-operate with a corresponding projecting portion 140 or 160 so as to retain ring sectors 10 on the ring support structure 3 when cold. The term "cold" is used in the present invention to mean the temperature at which the ring assembly is to be found when the turbine is not in operation, i.e. an ambient temperature that may for example be about 25° C. The projecting portion 140 is situated on the face 14*a* of the tab 14 that faces the flange 32. The projecting portion 160 is situated on the face 16*a* of the tab 16 that faces the flange 36. In the example shown, each tab 14 and 16 has a portion of extra thickness that forms the projecting portion 140 or 160.

In the in example shown, each housing 320 and 360 has two sloping portions. Thus, as shown in FIG. 2, the housing 360 presents a first sloping portion 360*a* and a second sloping portion 360*b*, each forming a non-zero angle with the radial and axial directions DR and DA. The first and second sloping portions 360*a* and 360*b* bear against the projecting portion 160 that co-operates with said housing 360. As shown, the first and second sloping portions 360*a* and 360*b* need not be mutually parallel. The housing 360 may also present a radial portion 360*c* extending along the radial direction DR and situated between the first sloping portion 360*a* and the second sloping portion 360*b*. In the example shown, the first and second sloping portions 360*a* and 360*b* when observed in meridian section form respective angles lying in the range 30° to 60° relative to the radial direction DR. In FIG. 2, $\alpha_1$ designates the angle formed between the first sloping portion 360*a* and the radial direction DR, $\alpha_2$ designates the angle formed between the first sloping portion 360*a* and the axial direction DA, $\alpha_3$ designates the angle formed between the second sloping portion 360*b* and the radial direction DR, and $\alpha_4$ designates the angle formed between the second sloping portion 360*b* and the axial direction DA. The first sloping portion 360*a* bears against the radially inner half Mi of the projecting portion 160, and the second sloping portion 360*b* bears against the radially outer half Me of the projecting portion 160. The housing 320 situated in the upstream flange 32 presents a structure similar to that described above for the housing 360.

Furthermore, the ring sectors 10 are also retained by retaining elements, in this example in the form of keepers 40*a* and 40*b*, e.g. in the form of pegs 40*a* and 40*b*. A first set of keepers 40*a* is engaged both in the upstream annular radial flange 32 and in the upstream tabs 14 of the ring sectors 10. For this purpose, each keeper 40*a* passes both through an orifice 35 formed in the upstream annular radial flange 32 and also an orifice 15 formed in each upstream tab 14, the orifices 35 and 15 being put into alignment when the ring sectors 10 on the ring support structure 3. In the same way, a second set of keepers 40*b* is engaged both in the downstream annular radial flange 36 and in the downstream tabs 16 of the ring sectors 10. For this purpose, each keeper 40*b* passes both through an orifice 37 formed in the downstream annular radial flange 36 and also an orifice 17 formed in each downstream tab 16, the orifices 37 and 17 being put into alignment when mounting the ring sectors 10 on the ring support structure 3.

The keepers 40*a* and 40*b* are made of a material having a coefficient of thermal expansion greater than the coefficient of thermal expansion of the ceramic matrix composite material of the ring sectors 10. By way of example, the keepers 40*a* and 40*b* may be made of metal material, e.g. of AM1 or Inconel 718 alloy. Clearance J is present when cold between the keepers 40*a* and 40*b* and the corresponding orifices 15 and 17 in the tabs 14 and 16. The expansion of the keepers 40*a* and 40*b* in the orifices 15 and 17 contributes to retaining the ring sectors 10 on the ring support structure 3 when hot by reducing or indeed eliminating the clearance J. The term "hot" is used herein to mean the temperatures to which the tabs of the ring sectors are subjected while the turbine is in operation, which temperatures may lie in the range 600° C. to 900° C. In the example shown, the ratio between the diameter $d_1$ of the portion of keeper 40*b* present in the orifice 17 and the diameter $d_2$ of said orifice 17 (i.e. $d_1/d_2$) lies in the range $(1+\alpha_{CMC})/(1+\alpha_m)$ and $1.1\times(1+\alpha_{CMC})/(1+\alpha_m)$, where $\alpha_m$ designates the coefficient of thermal expansion of said portion of keeper 40*b* and $\alpha_{CMC}$ designates the coefficient of thermal expansion of the ceramic matrix composite material of the ring sectors 10. This characteristic may also be true for the ratio of the diameter of the portion of keeper 40*a* present in the orifice 15 divided by the diameter of said orifice 15.

In addition, sealing is provided between sectors by sealing tongues received in grooves that face each other in facing edges of two neighboring ring sectors. A tongue 22*a* extends over almost the entire length of the annular base 12 in its middle portion. Another tongue 22*b* extends along the tab 14 and over a portion of the annular base 12. Another tongue 22*c* extends along the tab 16. At one end, the tongue 22*c* comes into abutment against the tongue 22*a* and against the tongue 22*b*. By way of example, the tongues 22*a*, 22*b*, and 22*c* are made of metal and are mounted with clearance when cold in their housings so as to provide the sealing function at the temperatures that are encountered in operation.

In conventional manner, ventilation orifices 33 formed in the flange 32 allow cooling air to be delivered from the outside of the turbine ring 1.

There follows a description of how an example turbine ring assembly as shown in FIG. 1 is assembled.

Each above-described ring sector 10 is made of ceramic matrix composite (CMC) material by forming a fiber preform of shape close to that of the ring sector and by densifying the preform with a ceramic matrix. In order to make the fiber preform, it is possible to use yarns made of ceramic fibers, e.g. yarns made of SiC fibers such as those sold by the Japanese supplier Nippon Carbon under the name "Nicalon", or yarns made of carbon fibers. The fiber preform is advantageously made by three-dimensional weaving, or by multilayer weaving, while leaving zones of non-interlinking that enable the portions of the preforms that correspond to the tabs 14 and 16 to be moved away from the sectors 10. The weaving may be of the interlock type, as shown. Other three-dimensional or multilayer weaves could be used, such as for example multi-plain or multi-satin weaves. Reference may be made to Document WO 2006/136755. After weaving, the blank may be shaped in order to obtain a ring sector preform that is then consolidated and then densified with a ceramic matrix, which densification may be performed in particular by chemical vapor infiltration (CVI), as is well known. A detailed example of fabricating CMC ring sectors is described in particular in Document US 2012/0027572.

The ring support structure 3 is made of a metal material such as a Waspaloy® or an Inconel 718 alloy.

Figure 3:
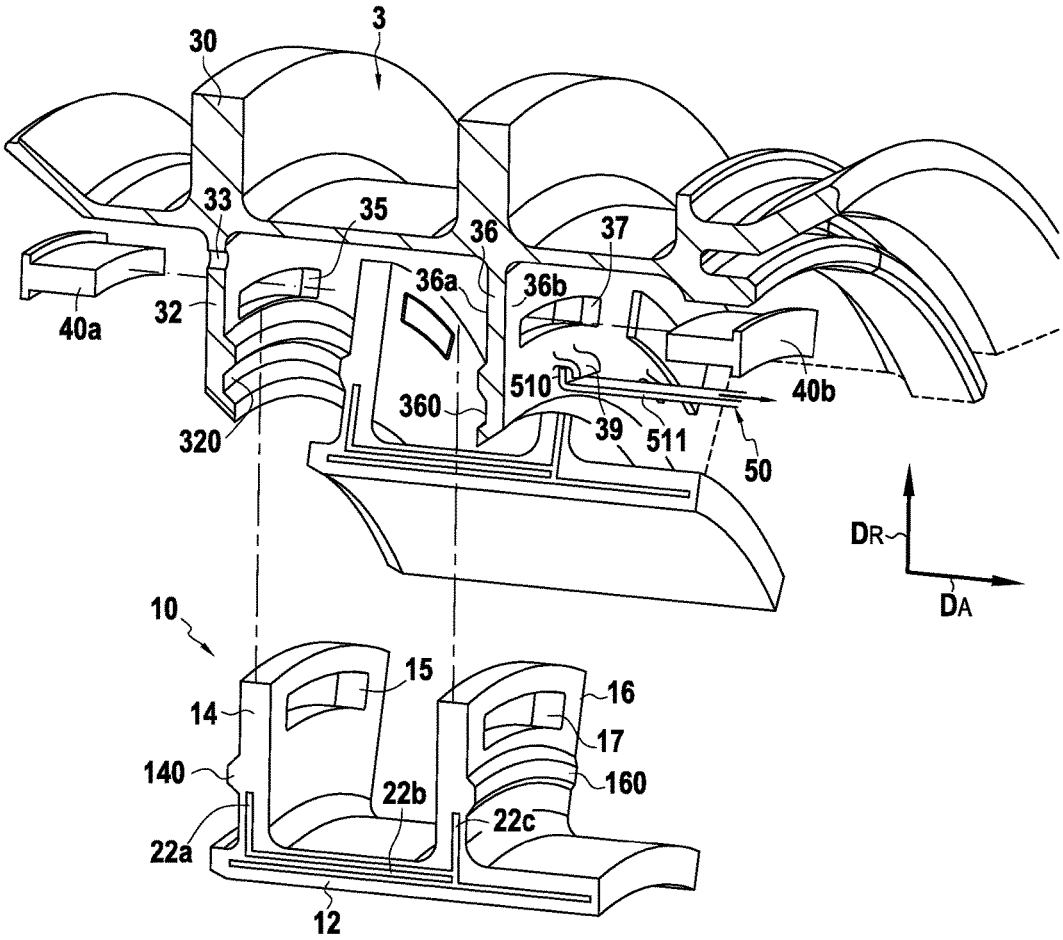
FIGS. 3 and 4 are diagrams showing how a ring sector is mounted in the ring support structure of the FIG. 1 ring assembly.

Assembly of the turbine ring assembly then continues by mounting ring sectors 10 on the ring support structure 3. The ring support structure 3 shown has at least one flange that is elastically deformable in the axial direction DA of the ring, in this example the downstream annual radial flange 36. While a ring sector 10 is being mounted, the downstream annular radial flange 36 is pulled in the direction DA, as shown in FIG. 3, so as to increase the spacing between the flanges 32 and 36, thereby enabling the ring sector 10 to be inserted between the flanges 32 and 36, without running the risk of damaging the ring sector 10. In order to make it easier to move the downstream annular radial flange 36 away, it includes a plurality of hooks 39 that are distributed over its face 36*b* that faces away from the face 36*a* of the flange 36 facing the downstream tabs 16 of the ring sectors 10. The traction exerted on the elastically deformable flange 36 in the axial direction DA is applied in this example by means of a tool 50 having a least one arm 51 with an end including a hook 510 that is engaged in a hook 39 present on the outer face 36*a* of the flange 36. The number of hooks 39 distributed over the face 36*a* of the flange 36 is defined as a function of the number of traction points that it is desired to have on the flange 36. This number depends mainly on the resilient nature of the flange. Other shapes and arrangements for the means that enable traction to be exerted in the axial direction DA on one of the flanges of the ring support structure may naturally be envisaged in the ambit of the present invention.

Figure 4:
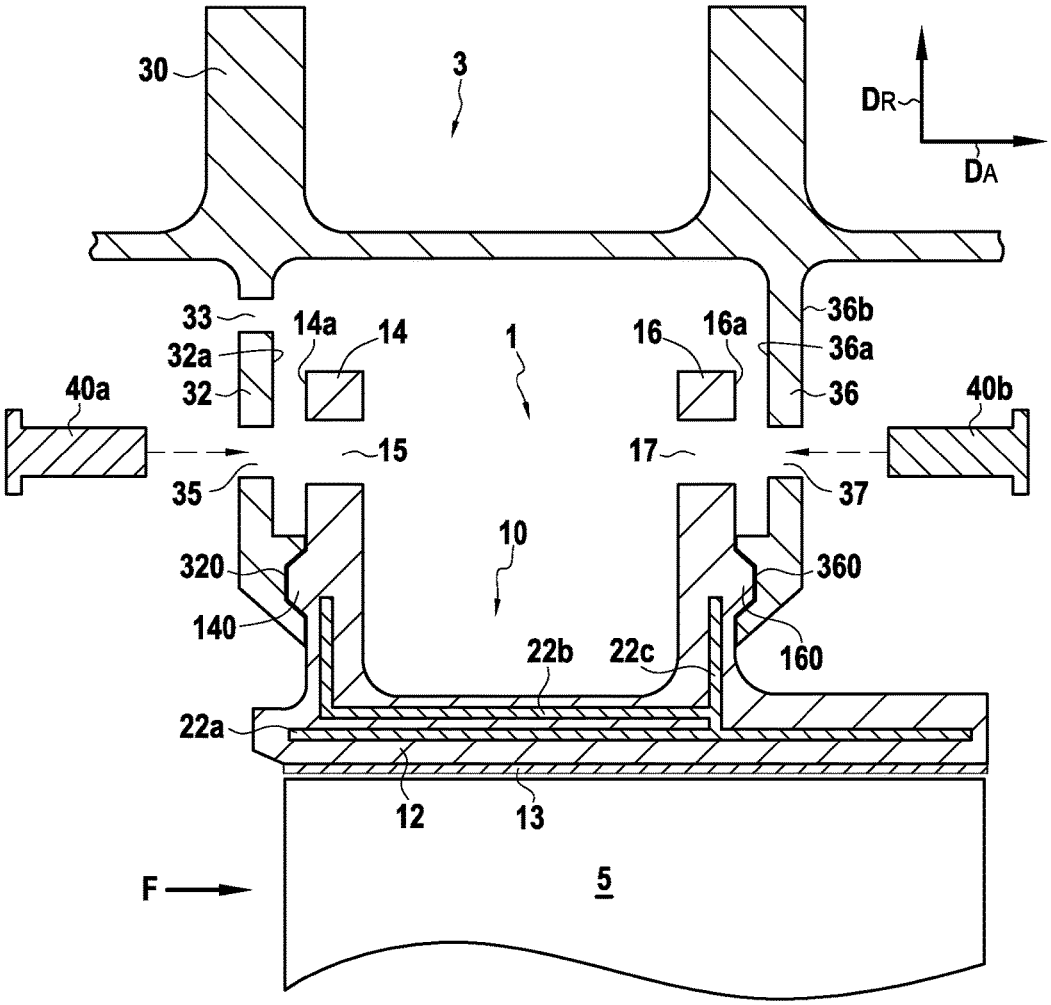

Once the annular flange 36 has been moved away in the direction DA, the ring sector 10 is inserted between the annular flanges 32 and 36. While inserting the ring sector 10, the projecting portion 140 is engaged in the housing 120 and the orifices 15 and 35 are put into alignment. The flange 36 is then released so as to introduce the projecting portion 160 into the housing 360 and put the orifices 17 and 37 into alignment. This produces the structure shown in FIG. 4, where the ring sectors 10 are retained while cold by co-operation between the projecting portions 140 and 160 and the housings 320 and 360. A keeper 40*a* is then engaged in the aligned orifices 35 and 15 formed respectively in the upstream annular radial flange 32 and in the upstream tab 14. In the same manner, a keeper 40*b* is engaged in the aligned orifices 37 and 17 formed respectively in the downstream annular radial flange 36 and in the downstream tab 16. The keepers 40*a* and 40*b* are inserted by force into the annular flanges 32 and 36 so as to provide retention when cold (e.g. an H6P6 fit or some other tight fit). Each ring sector tab 14 or 16 may include one or more orifices for passing one or more keepers.

When cold, the ring sectors 10 are retained by co-operation between the projecting portions 140 and 160 and the housings 320 and 360. When hot, expansion of the annular flanges 32 and 36 can mean that it is no longer possible to retain the ring sectors 10 via the housings 320 and 360. When hot, the ring sectors 10 are retained by expansion of the keepers 40*a* and 40*b* in the orifices 15 and 17, thereby reducing or eliminating the clearance J.

The term "lying in the range . . . to . . . " should be understood as including the bounds.

The invention claimed is:

1. A turbine ring assembly comprising:

a plurality of ring sectors made of ceramic matrix composite material forming a turbine ring, and a ring support structure having two annular flanges, each ring sector of the plurality of rings sectors having a portion forming an annular base with an inner face defining an inside face of the turbine ring and an outer face from which there project at least two tabs, the at least two tabs of each ring sector of the plurality of rings sectors being retained between the two annular flanges of the ring support structure, wherein each tab of the at least two tabs includes a projecting portion on its face situated facing one of the two annular flanges, said projecting portion co-operating with a housing present in the one of the two annular flanges, wherein each tab of the at least two tabs includes at least one opening in which there is received a portion of a retention element secured to the one of the two annular flanges situated facing said tab of the at least two tabs, clearance being present between the opening of said tab of the at least two tabs and the portion of the retention element present in said opening, said retention element being made of a material having a coefficient of thermal expansion that is greater than the coefficient of thermal expansion of the ceramic matrix composite material of the plurality of ring sectors, and wherein the housing in the one of the two annular flanges presents at least first and second sloping portions bearing against the projecting portion co-operating with said housing, said at least first and second sloping portions, when observed in meridian section, each forming a non-zero angle relative to a radial direction of the turbine ring and relative to an axial direction of the turbine ring.

2. An assembly according to claim 1, wherein the first sloping portion of the at least first and second sloping portions bears against a radially inner half of the projecting portion, and wherein the second sloping portion of the at least first and second sloping portions bears against a radially outer half of the projecting portion.

3. An assembly according to claim 1, wherein at least one of the first and second sloping portions forms an angle relative to the radial direction of the turbine ring assembly that lies in the range 30° to 60°.

4. An assembly according to claim 1, wherein the ratio of a diameter of the portion of the retention element that is present in said at least one opening divided by a diameter of said opening lies in the range $(1+\alpha_{CMC})/(1+\alpha_m)$ to $1.1\times(1+\alpha_{CMC})/(1+\alpha_m)$, where $\alpha_m$ designates the coefficient of thermal expansion of said portion of the retention element and $\alpha_{CMC}$ designates the coefficient of thermal expansion of the ceramic matrix composite material of the plurality of ring sectors, $\alpha_m$ and $\alpha_{CMC}$ being measured at 900° C. and being expressed as $10^{-6}\times$° C.$^{-1}$.

5. An assembly according to of claim 1, wherein each ring sector of the plurality of rings sectors presents a Pi-shape in axial section.

6. A turbine engine including a turbine ring assembly according to claim 1.

* * * * *